United States Patent [19]

Broudy

[11] 4,191,298

[45] Mar. 4, 1980

[54] RAILING DISPLAY RACK

[75] Inventor: Charles E. Broudy, Narberth, Pa.

[73] Assignee: Hart Schaffner & Marx, Chicago, Ill.

[21] Appl. No.: 823,390

[22] Filed: Aug. 10, 1977

[51] Int. Cl.[2] ..... A47F 3/14

[52] U.S. Cl. ..... 211/126

[58] Field of Search ..... 211/1, 2, 126–133, 211/134, 186–188, 150, 170; 248/148, 174, 175, 176; 52/36, 27, 79.6; 160/78, 80; 182/45, 82, 107–109, 179–181, 184, 200; 312/118, 129, 257 A

[56] References Cited

U.S. PATENT DOCUMENTS

| | | | |
|---|---|---|---|
| 1,497,330 | 6/1924 | Greene | 211/126 |
| 1,745,784 | 2/1930 | Davis | 211/126 X |
| 2,474,337 | 6/1949 | Sutherland et al. | 211/190 |
| 2,582,641 | 1/1952 | Matthews | 211/126 |
| 2,662,680 | 12/1953 | Bronson | 248/148 X |
| 3,258,128 | 6/1966 | McPherson | 211/133 |
| 3,722,702 | 3/1973 | Marker, Jr. | 211/204 |

*Primary Examiner*—William H. Schultz

*Attorney, Agent, or Firm*—Kinzer, Plyer, Dorn & McEachran

[57] ABSTRACT

A display rack for wearing apparel which also functions as a railing for steps. The display rack is open at its ends and supports wearing apparel across its front and rear faces. The display rack can be converted to accomodate either clothing support bars, wearing apparel storage bins, or both.

4 Claims, 7 Drawing Figures

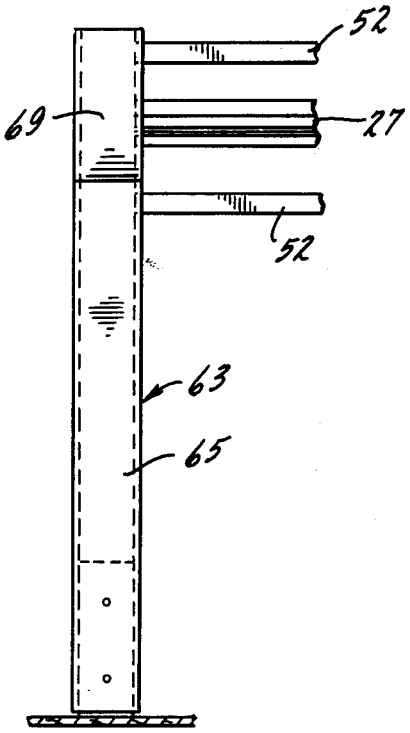
fig.4.
fig.5.
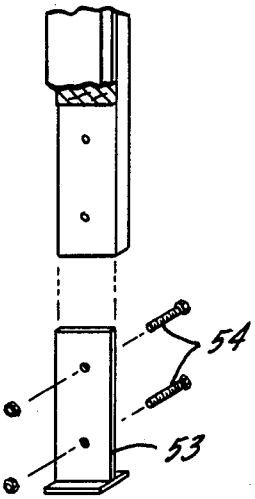
fig.6.
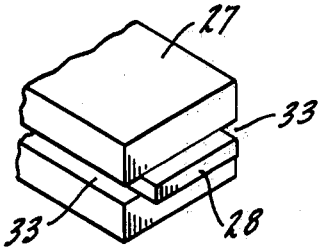
fig.7.
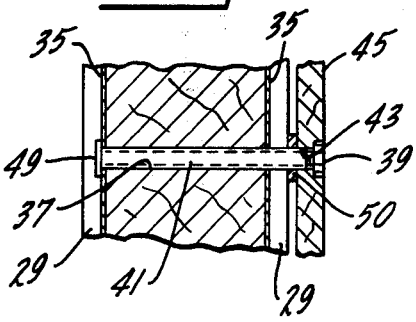

RAILING DISPLAY RACK

SUMMARY OF THE INVENTION

This invention is directed to a free standing display rack for wearing apparel which also functions as a railing for steps and elevated sales platforms.

An object of this invention is a wearing apparel display rack that can be used interchangeably for displaying wearing apparel supported on hangers as well as wearing apparel stored in bins and shelves.

Another object of this invention is a display rack that can be used for displaying both wearing apparel supported on hangers and wearing apparel stored in bins and shelves.

Another object is a wearing apparel display rack which can display merchandise to customers located on different horizontal levels.

Another object is a wearing apparel display rack which provides minimum visual obstruction to customers.

Another object is a wearing apparel display rack which functions visually as a bridge or connecting means between selling areas located at different horizontal levels.

Other objects may be found in the following specification, claims and drawings.

BRIEF DESCRIPTION OF THE DRAWINGS

The invention is illustrated more or less diagrammatically in the following drawings wherein:

FIG. 4 is a partial front elevational view of the display rack of FIG. 3;

FIG. 5 is an exploded perspective view showing a floor mounting arrangement for a display rack;

FIG. 6 is an enlarged partial detail of the longitudinally extending beam; and FIG. 7 is an enlarged cross-sectional view of the mounting for a storage bin.

DESCRIPTION OF THE PREFERRED EMBODIMENTS

Figure 1:
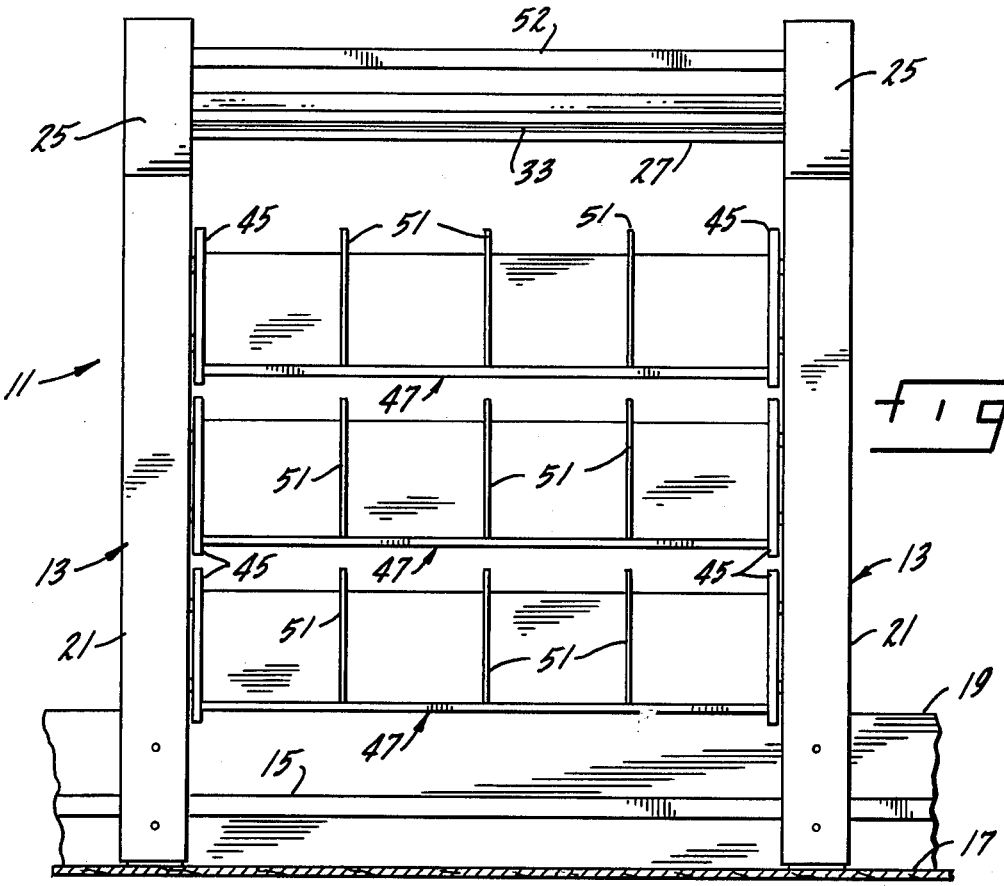
FIG. 1 is a front elevational view of one embodiment of the display rack of this invention.
Figure 2:
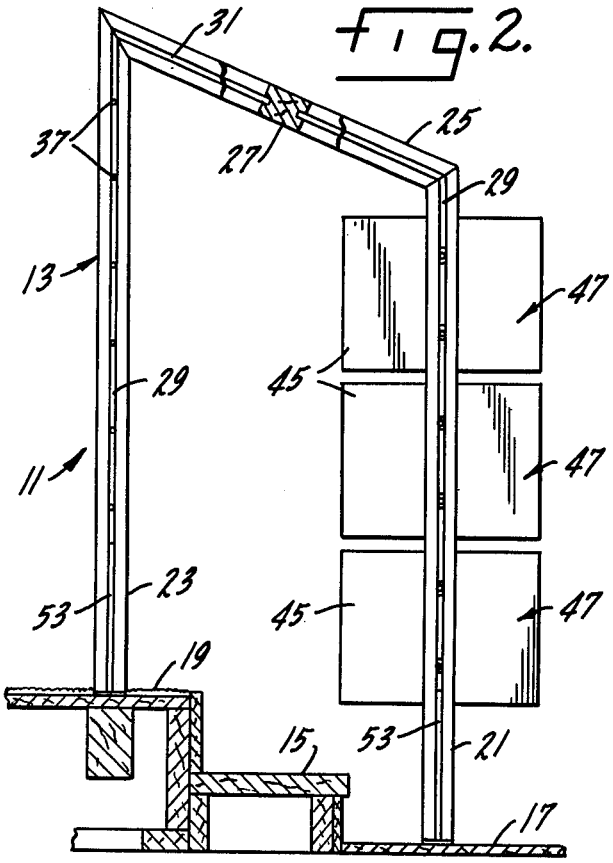
FIG. 2 is an end elevational view of the display rack of FIG. 1 with portions broken-away and shown in cross-section.

A display rack 11 of the type which also functions as a railing for steps connecting sale areas which are located at slightly different horizontal elevations is shown in FIGS. 1 and 2 of the drawings. The display rack 11 includes open end support members 13 which bridge the step 15 which connects a lower sales floor 17 with an upper sales floor or platform 19. Each end support member includes an upright post 21 supported on the lower floor 17 and an upright post 23 supported on the upper sales floor 19. For clarity of description, the post 21 will be referred to as the front post and the post 23 will be referred to as the rear post. The posts 21 and 23 are of equal height and are connected at their tops by a rail 25 which is mitered at the top of each post. The slope of the rail 25 is determined by the difference in elevation between the sales floors 17 and 19.

A longitudinally extending beam 27 connects the opposite end support members 13 and is fastened to the rails 25 of the end support members intermediate the ends of the beams. The opposite ends of the beam 27 are tendoned at 28 as shown in FIG. 6 so that the beam can be "let in" to the rails 25. The longitudinally extending beam 27 is positioned to be located in the same inclined plane as the rails 25. The upright posts, rails and beam are preferably cut from oak with the posts having nominal dimensions of 5½" by 3½". The rails have the same dimensions as the posts and the longitudinally extending beam has a thickness of 2½" and a width of 3½". It should be understood and appreciated that the material and dimensions of the posts, rails and beam may be varied in accordance with the dimensions of the display rack and the decor of the store in which the racks are to be installed.

Half-inch deep by half-inch wide grooves 29 are formed in the sides of the upright posts 21 and 23. These grooves connect with similar grooves 31 formed in the sides of the rails 25. Similar, but non-connecting grooves 33 are formed in the edges of longitudinally extending beam 27, primarily for symmetry of design. A half-inch wide 20-gauge brass strip 35 (FIG. 7) is installed in the bottom of each groove. Spaced bolt receiving holes 37 are drilled through the posts and the brass strips with the holes in one post aligned with holes in the corresponding post of the opposite end support member 13.

As can be seen most clearly in FIG. 7, bolts 39 are installed to extend through sleeves 41 which are located in the holes 37 and in holes 43 formed in the end walls 45 of wearing apparel display bins 47. The bins 47 are positioned between the upright posts of the end support members 13. The heads of the bolts are recessed in the end walls 45 of the bins. The opposite ends of the sleeves have flanges 49 which fit into the grooves 29. A spacer 50 surrounding the sleeve is positioned between the post and the bin.

Each bin has two vertically aligned holes 43 formed in each of its end walls 45. The bins may be of various designs and may be equipped with several removable or fixed transverse partitions 51 spaced along the length of the bin. The bins, located one above the other, extend across the front and rear faces of the display rack and face outwardly of the display rack. Conveniently, three bins are installed along each face of the display rack but the number of bins can be varied in accordance with the height of a particular display bin.

Support bars 52 may be used instead of, or in combination with the display bins. The support bars are mounted on the upright posts 21 and 23 near the tops thereof. Any conventional mounting for a support bar 52 may be utilized and preferably should be installed in the grooves 29. The support bars are normally used to support clothing hangers.

Upright posts 21 and 23 are anchored to their respective sales floors by inverted T-shaped brackets 53 shown in FIG. 5. The brackets are formed by metal angles connected back to back. The T-shaped bracket fits into a slot formed in the bottom of the post and is fastened to the post by bolts 54.

Figure 3:
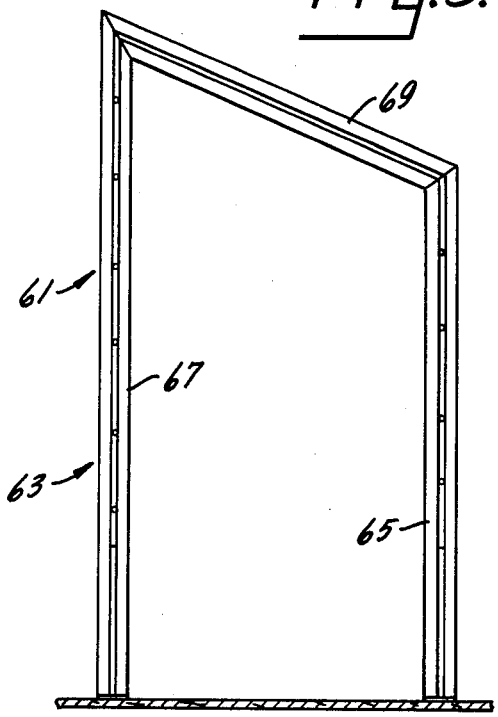
FIG. 3 is an end elevational view of a modified form of display rack.

A modified display rack 61 is shown in FIGS. 3 and 4 of the drawings. The modified rack 61 is intended to be used where the display rack does not bridge sales areas located at different horizontal elevations. It may be used in a store to complement display racks 11 by providing display racks for use on level surfaces having the same general appearance as the display racks 11.

The modified display rack 61 includes open end support members 63. Each end support member includes a shorter upright post 65 and a longer upright post 67. For clarity of description, the shorter post 65 will be referred to as the front post and the longer post 67 will be referred to as the rear post. The posts 65 and 67 are connected at their tops by a rail 69 which is mitered at the top of each post. The slope of the rail 69 is determined by difference in heights of the posts 65 and 67. Although it is desirable for aesthetic reasons to make the slope of the rail 69 similar to the slope of the rail 25 of the display rack 11 when the racks 61 and 11 are installed in the same store, it is not absolutely necessary. For example, in the preferred form, the post 67 is four feet six inches high while the post 65 is three feet six inches high. This one foot difference corresponds to the normal height between the lower sales floor 17 and upper sales floor 19 with which the display rack 11 is used. The remaining conception and features of the display rack 61 are identical to those described for the display rack 11.

The display rack 11 is shown with display bins 47 installed at its front face and a clothing hanger support bar 52 installed at its rear face. This arrangement could be reversed. Another possible arrangement is to install bins at both faces of the display rack. Yet another combination is that shown in FIGS. 3 and 4 wherein clothing hanger support bars 52 are installed at the front and rear faces of the rack.

I claim:

1. An elongated display rack for wearing apparel having a front display face and a rear display face, said rack including;

a pair of end support members, each end support member including a pair of spaced uprights, one located at the front face and the other located at the rear face of the rack, and a transversely extending rail connecting the tops of the uprights, the top of one upright of each pair of end support members extending above the top of the other upright, a longitudinal beam extending between said end support members and connected to the transversely extending rails of the end support members intermediate the ends thereof, said uprights being of equal length with the bottoms of the uprights located at one face of the rack being positioned at a higher level than the bottoms of the uprights located at the other face of the rack, and wearing apparel support means attached to the uprights and extending generally parallel to the front and rear faces of the display rack.

2. The display rack of claim 1 in which the transversely extending rails of the end support members lie in a plane inclined to the horizontal.

3. The display rack of claim 1 in which the wearing apparel support means are bars.

4. The display rack of claim 1 in which said wearing apparel support means are bins.

* * * * *